United States Patent [19]

Takayasu

[11] Patent Number: 4,610,773

[45] Date of Patent: Sep. 9, 1986

[54] IMMERSION TYPE ELECTRODE STRUCTURE

[75] Inventor: Teruko Takayasu, Nagoya, Japan

[73] Assignee: Showa Entetsu Co., Ltd., Nagoya, Japan

[21] Appl. No.: 768,933

[22] Filed: Aug. 26, 1985

Related U.S. Application Data

[63] Continuation of Ser. No. 636,358, Jul. 31, 1984, abandoned.

[30] Foreign Application Priority Data

Feb. 5, 1983 [JP] Japan ..... 59-121257[U]

[51] Int. Cl.[4] ..... C25B 11/03; C25C 7/02

[52] U.S. Cl. ..... 204/285; 204/287; 204/289; 204/290 F

[58] Field of Search ..... 204/285, 286, 287, 288, 204/289, 290 F

[56] References Cited

U.S. PATENT DOCUMENTS

| | | | |
|---|---|---|---|
| 2,109,975 | 3/1938 | Ott | 204/288 |
| 3,437,579 | 4/1969 | Smith | 204/286 |
| 3,857,774 | 12/1974 | Morton | 204/288 |
| 4,012,309 | 3/1977 | Eslien | 204/297 W |
| 4,039,403 | 8/1977 | Astley | 204/287 |
| 4,391,695 | 7/1983 | Koziol | 204/288 |

*Primary Examiner*—John F. Niebling

*Attorney, Agent, or Firm*—Parkhurst & Oliff

[57] ABSTRACT

Disclosed herein is an immersion type electrode structure comprising a power supply bus bar and an anode provided with a hanging current supply portion contacting with the power supply bus bar. In this structure, at least that portion of the bus bar which is immersed into a plating liquid and the hanging current supply portion are covered with a corrosion-resistant metal thin sheet.

3 Claims, 2 Drawing Figures

IMMERSION TYPE ELECTRODE STRUCTURE

This is a continuation of application Ser. No. 636,358 filed July 31, 1984 now abandoned.

BACKGROUND OF THE INVENTION (1) Field of the Invention

This invention relates to an immersion type electrode structure, and more particularly, the invention is to advantageously attain energy and resource-savings in electroplating.

(2) Description of the Prior Art

As a current supply means to an anode in the electroplating operation, there is generally used such a structure that a power supply bus bar ordinarily made of copper is extended over a plating bath and an anode is hanged down from the bus bar. That is, it is constructed that the power supply bus bar and the anode are brought into contact with each other at a place immediately above the upper surface of the plating liquid. However, when the bare copper as the bus bar is located immediately above the upper surface of the plating liquid, it begins to corrode in a short time due to the bad surrounding atmosphere, so that there are caused various problems as mentioned below.

(1) Since the surface of the bare copper is corroded in a short time to produce verdigris, the satisfactorily usable time of the bus bar is short even if the repair of the bus bar is frequently performed.

(2) The electric resistance at the contact current supply portion between the bus bar and the anode increases with the lapse of time due to the corrosion of the bus bar, thereby lowering the current supply efficiency.

(3) A required amount of electric energy is increased with the rise of the voltage due to the increase in the contact resistance and also it is necessary to repair and exchange the bus bar itself, which are uneconomical.

(4) In view of the public nuisance, there are problems such as the heat generation in the contact portion, the occurrence of gas due to the spattering of the plating liquid to the heat-generated portion, and the like.

(5) Since the operation and handling are necessary above the upper surface of the plating liquid, the operability is poor.

SUMMARY OF THE INVENTION

As a result of various studies to advantageously solve the abovementioned problems, the invention has been accomplished, which is based on the novel knowledge that the intended object can be extremely effectively attained by adopting a so-called immersion type electrode structure wherein the bus bar is brought into contact with the anode in the plating liquid.

According to the invention, there is the provision of an immersion type electrode structure comprising a power supply bus bar, a part of which being immersed into a plating liquid charged in an electroplating bath, and an anode provided with a hanging current supply portion contacting with the immersed portion of the power supply bus bar, wherein at least the immersed portion of the power supply bus bar and the hanging current supply portion of the anode are covered with a corrosion-resistant metal thin sheet.

The corrosion-resistant metal thin sheet covering the immersed portion of the power supply bus bar and the hanging current supply portion is made from Ti, Nb, Ta, or Zr are, and the thickness thereof is preferably about 0.2–2 mm.

BRIEF DESCRIPTION OF THE DRAWING

The invention will be described in detail with reference to the accompanying drawing, wherein.

DETAILED DESCRIPTION OF THE PREFERRED EMBODIMENT

Figure 1:
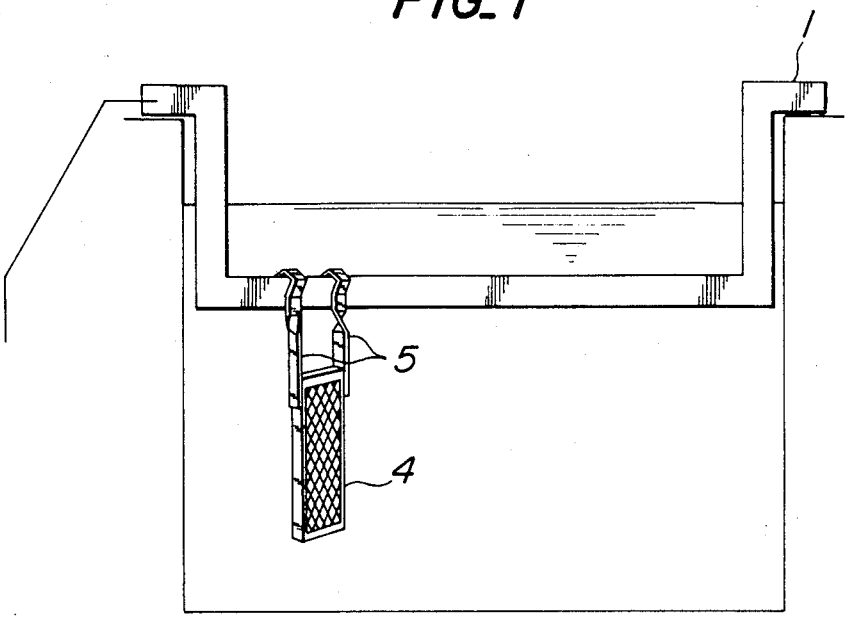
FIG. 1 is a schematic view of a preferred embodiment of the electrode structure according to the invention.
Figure 2:
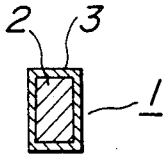
FIG. 2 is a sectional view of the power supply bus bar to be used in the invention.

In FIG. 1 is shown a preferred embodiment of the immersion type electrode structure according to the invention, wherein numeral 1 is a power supply bus bar. In the illustrated embodiment, as sectionally shown in FIG. 2, the bus bar 1 is constructed by covering a whole surface of a bus bar body 2 made of copper with a thin sheet of titanium 3. Further, numeral 4 is a basket type anode for nickel plating, which is provided with a hanging current supply portion 5, also covered with titanium.

In such an electrode structure, since the corrosion-resistant metal thin sheet, such as titanium sheet 3 covering at least the immersed portion of the power supply bus bar and the hanging current supply portion of the anode are passivated in the plating liquid, no current flows out from the surface of the metal thin sheet. However, when the immersed portion and the hanging portion are brought into contact with each other, the passivation of the metal thin sheet at the contact part between both the portions is easily broken, so that the current flowing property is not interrupted in the actual plating operation, and rather the current is efficiently flown into the anode through the point contact part.

As the covering method of the corrosion-resistant metal thin sheet, a seam clad welding method is advantageously adopted. It has been confirmed that when the covering is carried out by such a method, the reduction of the current flowing property hardly occurs.

The merits of the invention will be summarized as follows:

(1) Since the power supply bus bar is covered with the corrosion-resistant metal thin sheet, the surface thereof is not subjected to corrosion, so that it can be used semi-permanently, resulting in the resource-saving.

(2) Since the current effectively flows through the point contact part without undesirably causing stray current in the plating liquid, the current flowing property is excellent and is not reduced.

(3) Since the current supply contact part exists in the plating liquid, the contact resistance is low and the current flows at an efficiency of about 100%, so that the power loss hardly occurs. Further, since the bus bar itself can be semi-permanently used as mentioned above, the invention is very economical and largely contributes to the energy-saving.

(4) Since the contact part exists in the plating liquid, there is no heat generation due to the contacting and hence no production of gas, accordingly there is no fear about of public nuisance.

(5) Since there is neither obstacle above the upper surface of the plating liquid nor fear about gas generation, the operability is conspicuously enhanced.

What is claimed is:

1. An immersion type electrode structure for an electroplating bath, comprising:

a power supply bus bar completely covered with a thin layer of corrosion-resistant metal and having an upper and a lower portion;

means for suspending said bus bar by said upper portion such that said lower portion is completely immersed in the electroplating bath; and anode means completely covered with a thin layer of a corrosion-resistant metal and having a current supply hanger portion of a main body portion, said anode means being supported in said electroplating bath by hanging from said lower portion of said bus bar by said hanger portion and power being supplied to said anode means from said bus bar through the hanger portion.

2. The immersion type electrode structure according to claim 1, wherein said thin sheet of said corrosion-resistant metal is selected from the group consisting of Ti, Nb, Ta and Zr.

3. The immersion type electrode structure according to claim 1, wherein said thin sheet of said corrosion-resistant metal has a thickness of from 0.2 to 2 mm.

* * * * *

UNITED STATES PATENT AND TRADEMARK OFFICE

CERTIFICATE OF CORRECTION

PATENT NO. : 4,610,773

DATED : September 9, 1986

INVENTOR(S) : T. TAKAYASU

It is certified that error appears in the above-identified patent and that said Letters Patent is hereby corrected as shown below:

On the cover page, in Item [30], change "59-121257[U]" to --58-121257[U]--.

Signed and Sealed this

Thirteenth Day of October, 1987

*Attest:*

DONALD J. QUIGG

*Attesting Officer*

*Commissioner of Patents and Trademarks*